US006038872A

United States Patent [19]

Nojiri et al.

[11] Patent Number: 6,038,872

[45] Date of Patent: Mar. 21, 2000

[54] FROST DETECTING DEVICE

[75] Inventors: Toshiyuki Nojiri; Shinichi Saito, both of Tokyo, Japan

[73] Assignee: Ishizuka Electronics Corporation, Tokyo, Japan

[21] Appl. No.: 09/091,102

[22] PCT Filed: Nov. 28, 1996

[86] PCT No.: PCT/JP96/03486

§ 371 Date: Jun. 12, 1998

§ 102(e) Date: Jun. 12, 1998

[87] PCT Pub. No.: WO97/24568

PCT Pub. Date: Jul. 10, 1997

[30] Foreign Application Priority Data

Dec. 28, 1995 [JP] Japan ..... 7-343975

[51] Int. Cl.[7] ..... F25D 21/02

[52] U.S. Cl. ..... 62/140; 62/156; 62/158

[58] Field of Search ..... 62/151, 155, 156, 62/140, 158

[56] References Cited

U.S. PATENT DOCUMENTS

| | | | |
|---|---|---|---|
| 4,345,441 | 8/1982 | Hansen | 62/140 |
| 4,373,349 | 2/1983 | Mueller | 62/156 |
| 4,882,908 | 11/1989 | White | 62/156 X |
| 5,345,775 | 9/1994 | Ridenour | 62/140 |
| 5,522,232 | 6/1996 | Nojiri | 62/140 |
| 5,564,286 | 10/1996 | Suse | 62/153 |

FOREIGN PATENT DOCUMENTS

| | | |
|---|---|---|
| 0 505 315 A1 | 9/1992 | European Pat. Off. . |
| 51-119047 | 9/1976 | Japan . |
| 54-152246 | 11/1979 | Japan . |
| 54-157360 | 12/1979 | Japan . |
| 55-143482 | 10/1980 | Japan . |
| 59-13876 | 1/1984 | Japan . |
| 60-181557 | 9/1985 | Japan . |
| 1-225883 | 9/1989 | Japan . |
| 2-115678 | 4/1990 | Japan . |
| 5-45040 | 2/1993 | Japan . |
| 7-260326 | 10/1995 | Japan . |

*Primary Examiner*—Harry B. Tanner
*Attorney, Agent, or Firm*—McDermott, Will & Emery

[57] ABSTRACT

A frost detecting device including a frost detector which detects the amount of frost from the temperature difference between a detecting thermal sensitive element and a compensating thermal sensitive element is provided. The frost detecting device includes: a frost detector 1 made up of a detecting thermal sensitive element and a compensating thermal sensitive element; an amplifier circuit 2 for amplifying an output signal from the frost detector 1; a comparator circuit 3 for comparing an output voltage from the amplifier circuit 2 with a set level; an operation detecting circuit 5 for detecting operating conditions of a compressor and a cooling fan 4; and a judging circuit 6 for detecting the amount of frost in accordance with output voltages from the operation detecting circuit 5 and the comparator circuit 3. The output from the comparator circuit 3 is used to detect the amount of frost only when the compressor and the cooling fan 4 are both in operation.

5 Claims, 7 Drawing Sheets

ON
OFF
COMPRESSOR

ON
OFF
V3

ON
OFF
V4

ON
OFF
V1

ON
OFF
V2

ON
OFF
V5

T1 T1
T1 T1
T1 T1
P1
SET LEVEL Vr
FROST DETECTED
T2
t1
t2
t3
t4
t5
t6
t7
t8

FROST DETECTING DEVICE

DETAILED DESCRIPTION OF THE INVENTION

1. Field of the Invention

The present invention relates to a frost detecting device used in various industrial machines and refrigerators.

2. Related Art

Frost on the surface of the cooling fan of a heat exchanger incorporated into a refrigerator reduces the cooling efficiency. A continuous operation with the frost uneconomically increases energy consumption, and often causes failure. In view of this, a frost detecting method generally used includes the steps of: switching on and off the compressor by detecting the inner temperature of a refrigerator; cooling for a predetermined period of time using a timer; after the cooling is performed for a predetermined period of time, switching to a heating operation to defrost; and, after the defrosting for a predetermined period of time, stopping the heating operation.

Although the start of defrosting can be controlled in the above method, the frosting condition cannot be controlled, because it changes depending on ambient temperature, humidity, frequency of opening the door, and the content of the refrigerator. Since the actual frosting condition cannot be detected by the above method, defrosting is performed even in non-frosting condition, or it is not performed in an over-frosting condition. This unnecessarily increases energy consumption.

In order to solve the problems in the conventional defrosting method, various frost detecting methods have been developed. However, they have many drawbacks in practical use, such as faulty operation and detection inaccuracy. FIG. 6 shows an example of a frost and dew detecting device produced for a freezer or refrigerator. Japanese Patent Application Laid-Open No. 2-115678 discloses such frost and dew detecting device.

The frost and dew detecting device is provided with a pair of thermal sensitive elements R1 and R2 adjacent to each other. Each thermal sensitive element has a current supply source. One of the thermal sensitive elements R1 and R2 is provided with an electric current source which generates heat in the air so as to cause a temperature rise, while the other thermal sensitive element is provided with a set electric current source which is not affected by the temperature rise. The thermal sensitive element that receives current from the electric current source is kept at a temperature higher than that of the other thermal sensitive element that receives current from the set electric current source.

If frost or dew forms on the pair of thermal sensitive elements that are kept at different temperatures, heat diffusion occurs through the frost or dew on the surface of the thermal sensitive element of the higher temperature, as the heat conductivity of a solid or liquid material is higher than that of air. The temperature of the thermal sensitive element is lowered due to the heat diffusion, and the temperature difference between the two thermal sensitive elements becomes smaller. The temperature difference is determined by an arithmetic circuit and compared with a predetermined reference value. If the determined temperature difference is smaller than the reference value, it is judged to be in a frosting and dewing condition.

PROBLEMS TO BE SOLVED BY THE INVENTION

The conventional frost and dew detecting device mounted to a refrigerator has drawbacks as follows. Generally, a refrigerator has a compressor and a cooling fan which operate at the same time in a cooling operation. FIG. 7A shows a frost and dew detecting device. The frost and dew detecting device 10 is a series circuit made up of thermal sensitive elements 10*a* and 10*b*. The output voltage Va of the series circuit is inputted into an amplifier circuit 11, whose output voltage V1 is inputted into a comparator circuit 12. A reference voltage Vr outputted from a level setting circuit 13 is inputted into the comparator circuit 12. As shown in FIG. 7B, the compressor repeats an on-off operation so that the inner temperature becomes constant through temperature detection by a temperature sensor disposed inside the refrigerator. In general use, however, a constant operation is repeated as indicated by a timing chart of the compressor. Some time after the compressor starts operating at time $t_1$, frost starts forming on the thermal sensitive elements of the evaporator (cooler) and the frost and dew detecting device, and the temperature difference between the thermal sensitive elements R1 and R2 becomes smaller. The output voltage V1 of the amplifier circuit 2 gradually becomes lower.

If the compressor and the cooling fan stops operating even though frost has not formed enough on the frost detector, i.e., if the compressor and the cooling fan stops operating when the signal voltage V1 is still higher than the set level Vr of the comparator 12, the output voltage V1 relative to the temperature difference between the thermal sensitive elements R1 and R2 is returned to the initial value of time $t_c$. As a result, the signal voltage V1 becomes lower than the set level Vr, and a signal voltage V2 is outputted. The conventional detecting device detects frost which has not actually formed, and goes into a defrosting operation. Although it operates correctly as long as the compressor and the cooling fan are both in operation, it starts a faulty operation when the compressor and the cooling fan stop operating.

The present invention is aimed at eliminating the above problem, and providing a frost detecting device using a frost detector which detects the amount of frost from the temperature difference between a detecting thermal sensitive element and a compensating thermal sensitive element.

The frost detecting device of the present invention also prevents the possibility of faulty operation which is caused due to total dependence on the operations of the compressor and the cooling fan.

MEANS TO SOLVE THE PROBLEMS

To achieve the above object, the present invention provides a frost detecting device which comprises: a frost detector made up of a detecting thermal sensitive element and a compensating thermal sensitive element; an amplifier circuit for amplifying an output signal from the frost detector; a comparator circuit for comparing an output voltage from the amplifier circuit with a set level; an operation detecting circuit for detecting operating conditions of a compressor and a cooling fan; and a judging circuit for detecting existence of frost in accordance with output voltages from the operation detecting circuit and the comparator circuit. The amount of frost is detected in accordance with the output from the judging circuit, with the operation detecting circuit monitoring the operations of the compressor and the cooling fan.

The present invention provides a frost detecting device which comprises: a frost detector made up of a detecting thermal sensitive element and a compensating thermal sensitive element; an amplifier circuit for amplifying an output signal from the frost detector; a comparator circuit for comparing an output voltage from the amplifier circuit with a set level; an operation detecting circuit for detecting operating conditions of a compressor and a cooling fan; a delayed pulse generating circuit which operates in accordance with an output signal from the operation detecting circuit; and a judging circuit for detecting existence of frost in accordance with a pulse output signal from the delayed pulse generating circuit and an output voltage from the comparator circuit. The amount of frost is detected based on the output from the judging circuit in synchronization with a delayed pulse generated in accordance with the operation of the operation detecting circuit, which monitors the operations of the compressor and the cooling fan.

The present invention provides a frost detecting device which comprises: a frost detector made up of a detecting thermal sensitive element and a compensating thermal sensitive element; an amplifier circuit for amplifying an output signal from the frost detector; a comparator circuit for comparing an output voltage from the amplifier circuit with a set level; an operation detecting circuit for detecting operating conditions of a compressor and a cooling fan; a delayed pulse generating circuit which operates in accordance with output signals from the operation detecting circuit when the compressor and the cooling fan are both in operation; and a judging circuit for detecting frost in accordance with a pulse output signal from the delayed pulse generating circuit and an output voltage from the comparator circuit. A delayed pulse is generated in accordance with the output from the operation detecting circuit when the compressor arid the cooling fan are both in operation. The output of the judging circuit is transmitted in synchronization with the delayed pulse so that the amount of frost can be detected after a predetermined period of time has passed.

EMBODIMENTS OF THE INVENTION

Figure 1:
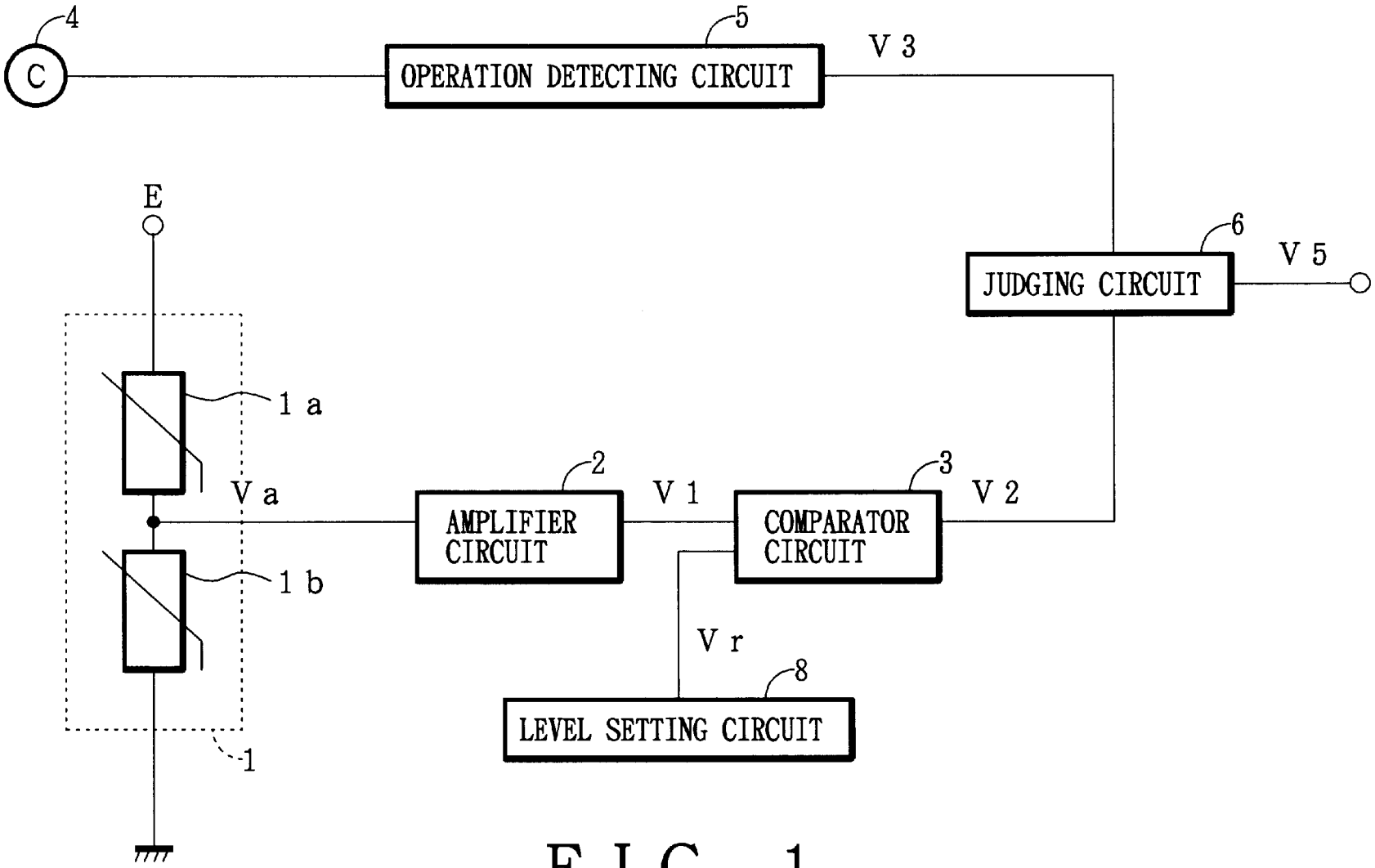
FIG. 1 is a circuit diagram showing an embodiment of a frost detecting device of the present invention.

The following is a description of one embodiment of a frost detecting device of the present invention, with reference to the accompanying drawings. FIG. 1 is a circuit diagram illustrating the embodiment of the frost detecting device of the present invention in FIG. 1, the frost detecting device comprises a frost detector 1, an amplifier circuit 2 for amplifying an output signal transmitted from the frost detector 1, a comparator circuit 3 for comparing the output of the amplifier circuit 2 with a set level (reference voltage) determined depending on the amount of frost, a level setting circuit 8 for generating the set level (reference voltage) supplied to the comparator circuit 3, an operation detecting circuit 5 for detecting a halt of operation of a compressor and a cooling fan 4, and a judging circuit 6 for detecting frost in accordance with the operations of the compressor and the cooling fan 4.

Figure 2A:
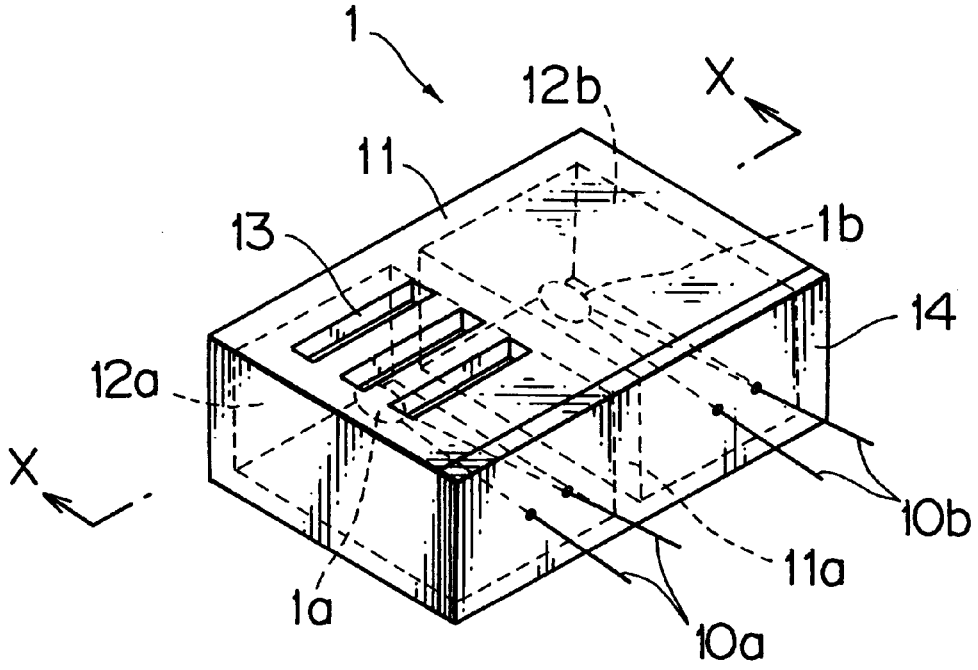
FIG. 2A is a perspective view showing a frost detector used in the frost detecting device of the present invention.
Figure 2B:
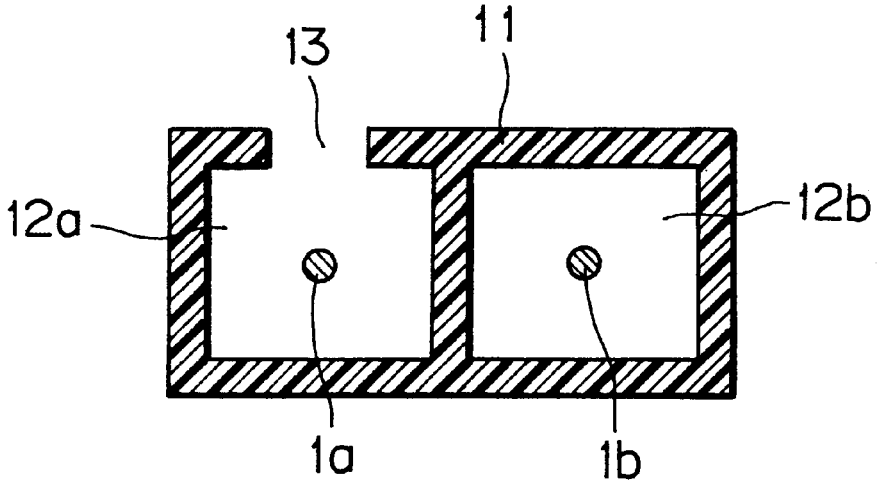
FIG. 2B is a sectional view of the frost detector taken along a line X—X.

FIG. 2A is a perspective view of the frost detector 1, and FIG. 2B is a sectional view of the frost detector 1 taken along the line X—X of FIG. 2A. In these drawings, the frost detector 1 is made up of a detecting thermal sensitive element 1*a* and a compensating thermal sensitive element 1*b*, and a container 11 for accommodating these elements. The frost detector 1 serves as a sensor which determines the amount of frost from the potential difference, i.e., the temperature difference, obtained by a circuit formed by the thermal sensitive elements.

As shown in FIG. 2, the container 11 of the frost detector 1 is provided with a partition wall 1*a* and a cover 14. Hollow portions 12*a* and 12*b* are formed inside the frost detector 1. The hollow portion 12*a* is provided with openings 13. The detecting thermal sensitive element 1*a* is disposed inside the hollow portion 12*a*, while the compensating thermal sensitive element 1*b* is disposed inside the sealed hollow portion 12*b*. Lead wires 10*a* and 10*b* of the detecting thermal sensitive element 1*a* and the compensating thermal sensitive element 1*b* extend outward from the cover 14. This front detecting device is disposed inside a refrigerator. If no frost forms at the openings 13, a temperature difference is caused between the detecting thermal sensitive element 1*a* and the compensating thermal sensitive element 1*b*, as the air in the refrigerator moves out through the openings 13. However, if the openings 13 are blocked by frost, the detecting thermal sensitive element 1*a* and the compensating thermal sensitive element 1*b* are sealed in the hollow portions 12*a* and 12*b*, i.e., the resistance of the detecting thermal sensitive element 1*a* becomes equal to that of the compensating thermal sensitive element 1*b* as the physical conditions of the two elements are the same. As a result, the terminal voltages of the two elements become the same, and the temperature difference between them becomes zero. The frost detector used in the frost detecting device of the present invention detects a frosting situation from the temperature difference between the two thermal sensitive elements on the principle as described above.

More specifically, the detecting thermal sensitive element 1*a* and the compensating thermal sensitive element 1*b* are connected in series between a voltage power source E and a ground. An output voltage Va can be expressed as follows:

$$Va=E\cdot Rb/(Ra+Rb) \quad (1)$$

wherein the resistance values of the detecting thermal sensitive element 1*a* and the compensating thermal sensitive element 1*b* are Ra and Rb, respectively.

If the resistance value Ra of the detecting heat resistance element decreases as the temperature rises, the terminal voltage of the compensating thermal sensitive element 1*b* can be expressed using the equation (1) as follows:

$$Va=E\cdot Rb/[(Ra-\Delta Ra)+Rb] \quad (2)$$

wherein the resistance value Rb of the compensating thermal sensitive element 1*b* is constant. E is the applied voltage, and (Ra−ΔRa) is the resistance value of the detecting thermal sensitive element 1*a*.

The output Va of the frost detecting device is inputted into an amplifier circuit 2, where it is amplified. The output voltage V1 from the amplifier circuit 2 is then inputted into a comparator circuit 3. Here, a set level (reference voltage) Vr from the level setting circuit 8 has already been inputted into the comparator circuit 3, which compares the output voltage V1 with the set level Vr. If the output voltage V1 becomes lower than the set level Vr, an output voltage V2 from the comparator circuit 3 is inputted into the judging circuit 6, and then outputted from the judging circuit 6 in synchronization with an output voltage V3 from the operation detecting circuit 5 depending on the operation of the compressor 4. Thus, the amount of frost can be detected.

Figure 3:
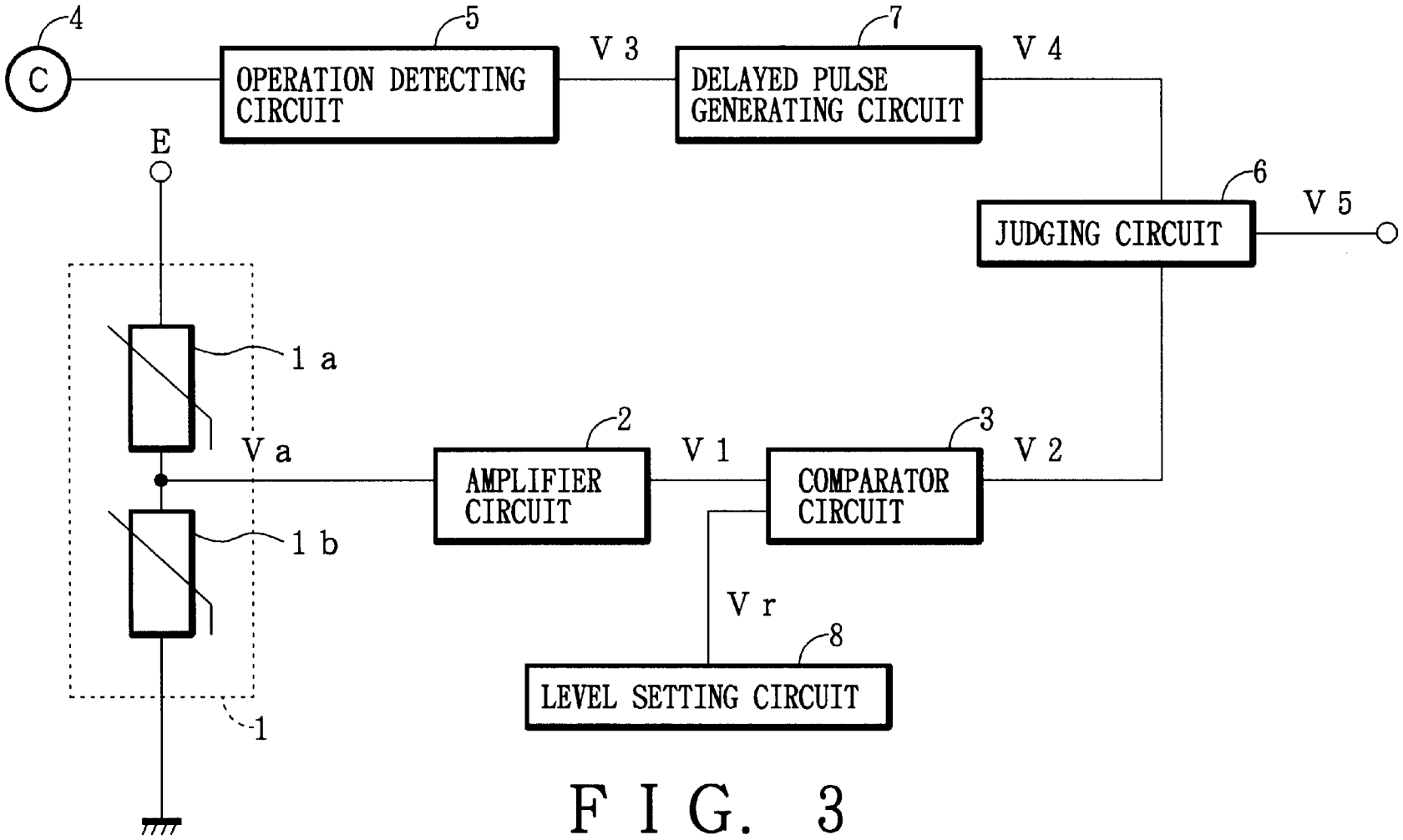
FIG. 3 is a circuit diagram showing another embodiment of a frost detecting device of the present invention.

FIG. 3 illustrates another embodiment of the frost detecting device of the present invention. The frost detecting device in this figure comprises a frost detector 1, an amplifier circuit 2 for amplifying the output voltage Va of the frost detector 1, a comparator circuit 3 for comparing the output voltage V1 from the amplifier circuit 2 with a set level (reference voltage Vr) predetermined depending on the amount of frost to be detected, an operation detecting circuit 5 for detecting a halt of the operation of a compressor and a cooling fan 4, a delayed pulse generating circuit 7 for generating a pulse delayed depending on the output of the operation detecting circuit 5, and a judging circuit 6 for detecting frost in accordance with the delayed pulse generated from the delayed pulse generating circuit 7.

The delayed pulse generating circuit 7 generates a delayed pulse at intervals of a predetermined time T1 after the operation detecting circuit 5 is turned on. The comparator circuit 3 judges whether the output voltage V1 of the amplifier circuit 2 is greater than the set level (the amount of frost). The judging circuit 6 detects frost in synchronization with the output voltage V2 of the comparator circuit 3 and the delayed pulse generated from the delayed pulse generating circuit 7. Since the compressor 4 repeats an on-off operation, the output voltage of the amplifier circuit 2 becomes unstable as the evaporator (cooler) is not cold enough right after operation starts. Because of this, the delayed pulse generating circuit 7 is disposed in a stage right after the operation detecting circuit 5 for the compressor 4, so that a pulse delayed by a predetermined time (T1) from the start of the operation of the compressor 4 is inputted into the judging circuit 6.

Figures 4A, 4B, 4C, 4D, 4E, 4F:
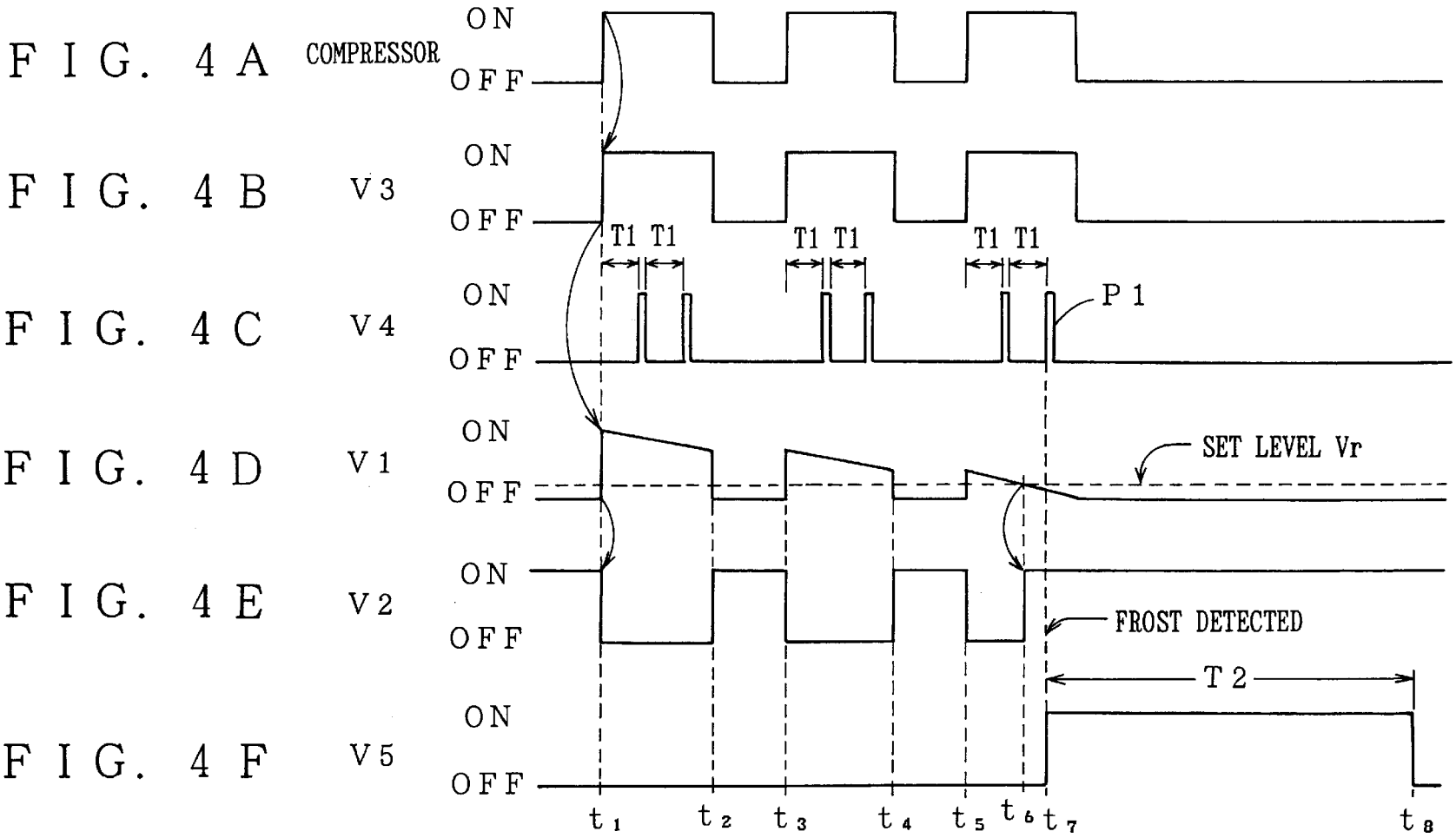
FIG. 4A to 4F are timing charts illustrating the operation of the frost detecting device of FIG. 3.

FIGS. 4A to 4F are timing charts illustrating the operation of the frost detecting device of FIG. 3. FIG. 4A is a waveform illustrative of the operation of the compressor 4; FIG. 4B is an output waveform illustrative of the operation detecting circuit 5; FIG. 4C is a pulse waveform generated from the delayed pulse generating circuit 7; FIG. 4D is an output waveform illustrative of the amplifier circuit 2; FIG. 4E is an output waveform illustrative of the comparator circuit 3; and FIG. 4F is an output waveform illustrative of the judging circuit 6.

This frost detecting device is incorporated into a refrigerator. The compressor 4 of the refrigerator detects the inside temperature and, according to the detection results, repeats on-off operations. When the temperature inside the refrigerator becomes as low as the predetermined temperature, the compressor 4 stops operating. As shown in FIG. 4B, the operation detecting circuit 5 outputs a pulse-shaped output waveform in synchronization with the on-off operation of the compressor 4, as shown in FIG. 4A. The output of the operation detecting circuit 5 is inputted into the delayed pulse generating circuit 7, which generates a pulse at intervals of time T1, as shown in FIG. 4C. The output of the delayed pulse circuit 7 is then inputted into the judging circuit 6. At time $t_1$, the compressor 4 starts operating. At this point, no frost has formed at the openings 13 of the frost detector 1, and the voltage V1 corresponding to the temperature difference between the detecting thermal sensitive element 1*a* and the compensating thermal sensitive element 1*b* is higher enough than the set level Vr. When the compressor 4 starts operating for the second time (at time $t_3$), frost has started forming at the openings 13 of the frost detector 1. Since the openings 13 are not blocked at this point, the voltage V1 is higher than the set level Vr. When the signal voltage V3 of the operation detecting circuit 5 is on, the delayed pulse generating circuit 7 generates a delayed pulse as shown in FIG. 4C.

When the compressor 4 starts operating for the third time at time $t_5$, the openings 13 of the frost detector 1 are not yet blocked by frost. At time $t_6$, however, the openings 13 are blocked by frost, and the output level of the frost detector 1 becomes lower than the set level Vr. As shown in FIG. 4E, the output level is reversed to H level at time $t_6$. As shown in FIG. 4F, the output of the judging circuit 6 is reversed from L level to H level in synchronization with the delayed pulse P1 at time $t_7$. After frost is detected, the output voltage V5 of the judging circuit 6 is turned on.

Figure 5:
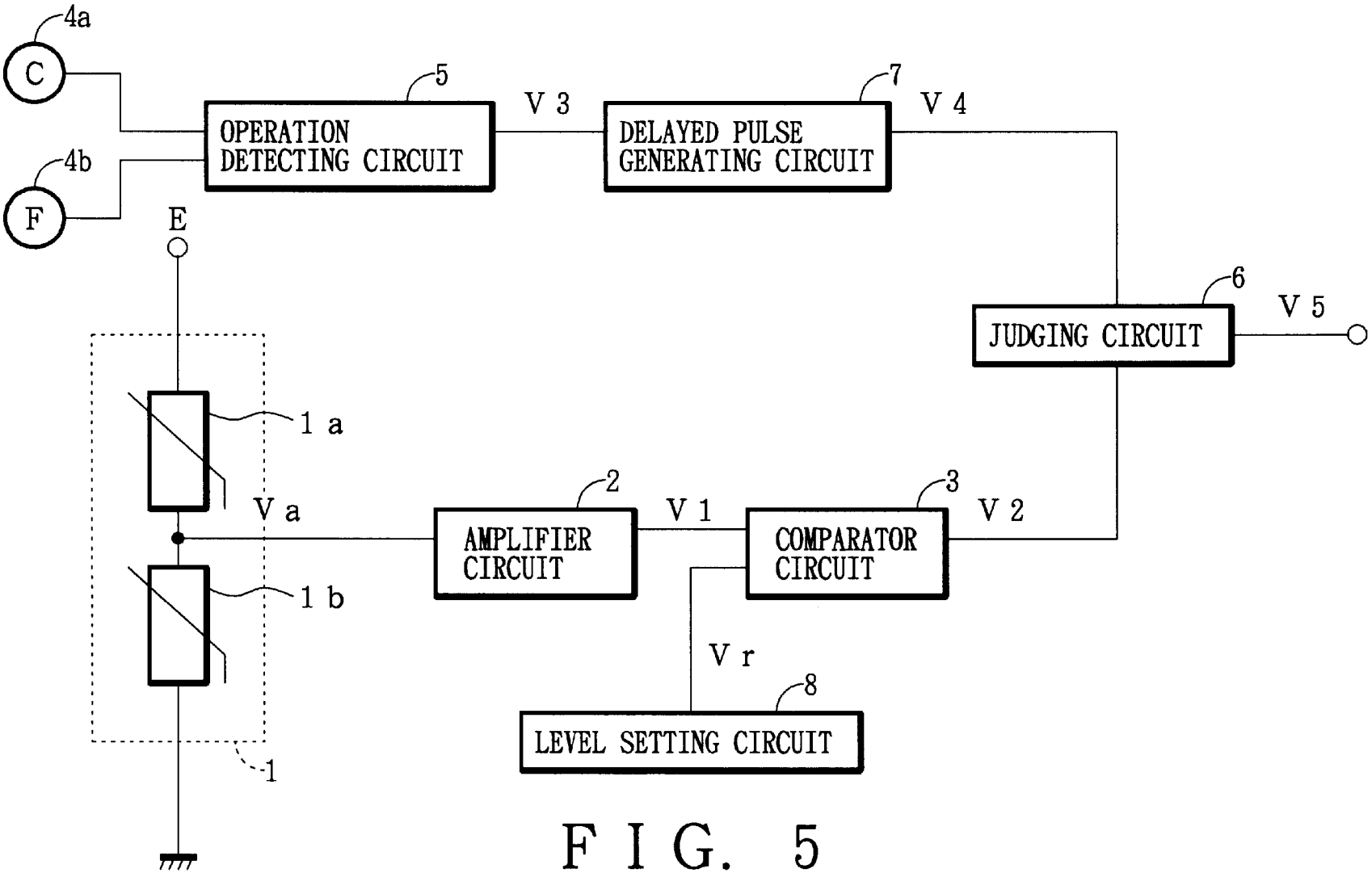
FIG. 5 is a circuit diagram showing yet another embodiment of a frost detecting device of the present invention.
Figure 6:
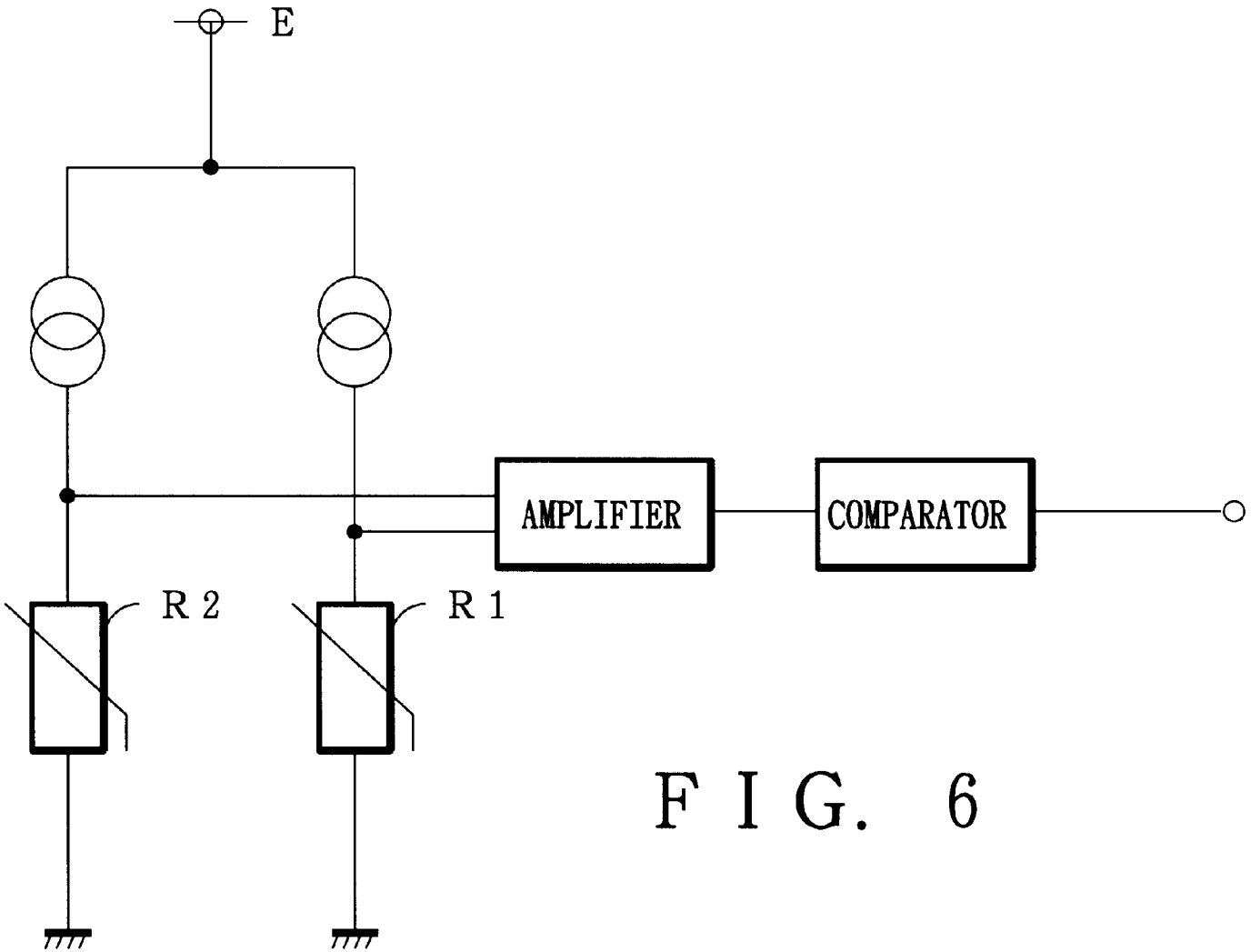
FIG. 6 is a circuit diagram showing an example of a conventional frost detecting device.
Figure 7A:
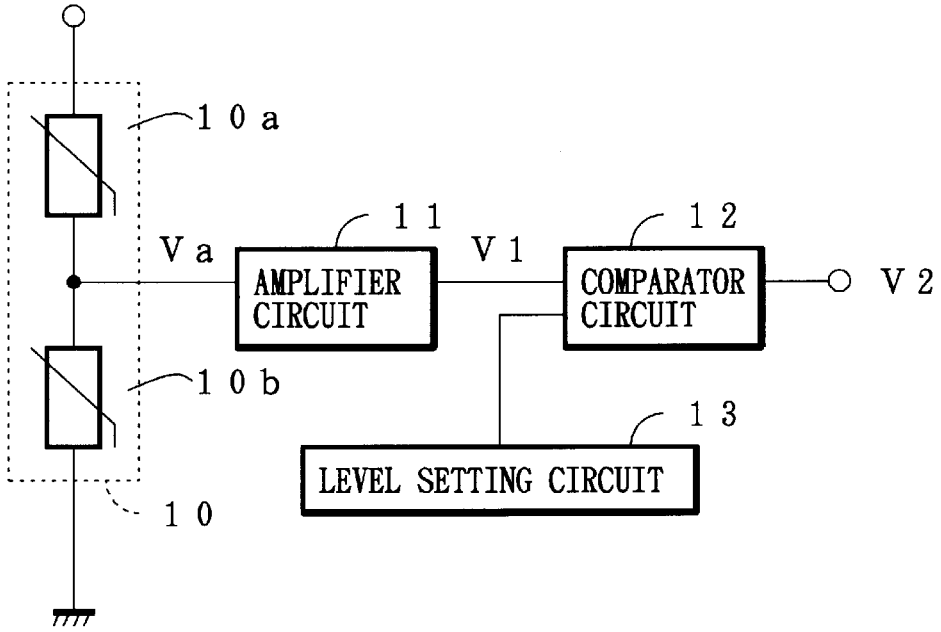
FIG. 7A is a circuit diagram showing another example of a conventional frost detecting device.
Figure 7B:
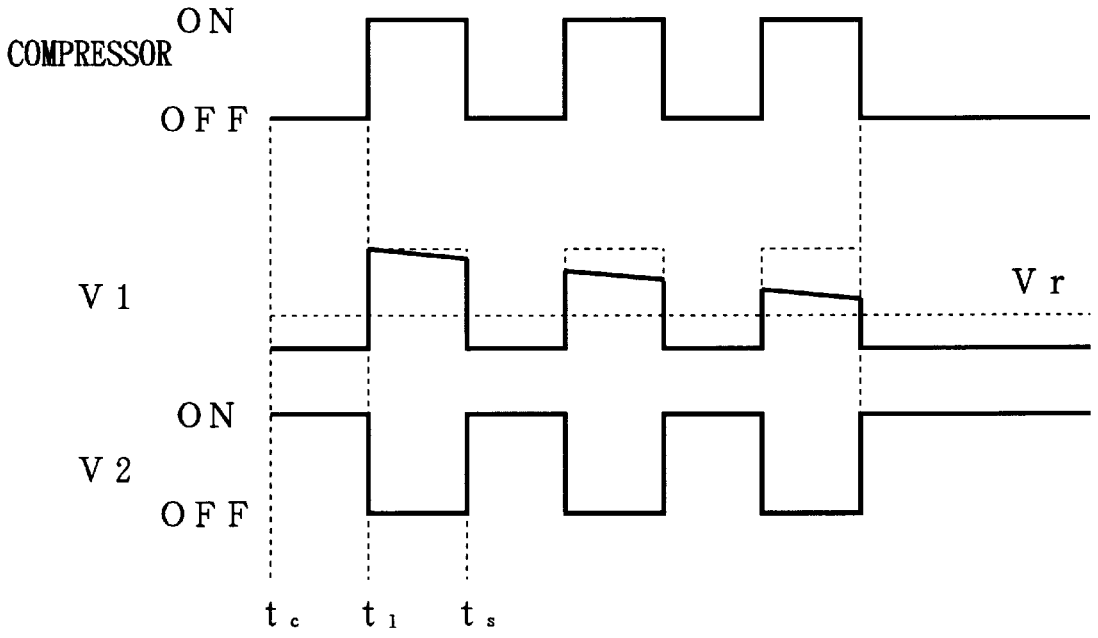
FIG. 7B is a timing chart of the conventional frost detecting device.

FIG. 5 shows yet another embodiment of the present invention.

In the previous embodiment, a compressor and a cooling fan operate in accordance with opening and closing of the door, but they do not necessarily operate at the same time. Accordingly, the compressor and the cooling fan operate independently of each other in this embodiment.

The frost detecting device shown in FIG. 5 monitors operations of a compressor 4*a* and a cooling fan 4*b* which work independently of each other, and the remaining components are the same as in the embodiment shown in FIG. 3. In this embodiment, the compressor 4*a* and the cooling fan 4*b* are separately monitored. Only when the compressor 4*a* and the cooling fan 4*b* are both in operation, is the signal voltage V3 of the operation detecting circuit 5 turned on to activate the delayed pulse generating circuit 7 to generate a delayed pulse. The delayed pulse generating circuit 7 outputs a pulse voltage V4.

As the amount of frost on the surface of the frost detector 1 attached to an evaporator (cooler) increases, the openings 13 formed on the detecting thermal sensitive element 1*a* are blocked. Here, the temperature difference between the detecting thermal sensitive element 1*a* and the compensating thermal sensitive element 1*b* becomes zero, and the voltage V1 becomes lower than the set level. The output voltage V2 of the comparator circuit 3 is turned on. When the pulse signal V4 and the output voltage V2 are on, the output voltage V5 of the judging circuit 6 is also on, so that the judging circuit 6 can detect the frosting situation of the evaporator. Accordingly, in the embodiment shown in FIG. 5, operations of the compressor 4*a* and the cooling fan 4*b* are separately monitored, and the operation detecting circuit 5 output the signal voltage only when the compressor 4*a* and the cooling fan 4*b* are both in operation. This eliminates the possibility of faulty operation, and ensures reliable frost detection.

EFFECTS OF THE INVENTION

As described so far, the present invention eliminates the possibility of faulty operation by providing a frost detecting device which comprises a frost detector attached to an evaporator (cooler) inside a refrigerator for detecting operating conditions of the compressor and the cooling fan, and a judging circuit for detecting frost from the signal voltages from the compressor and the cooling fan and the output from the frost detector.

According to the present invention, frosting condition of the evaporator can be accurately detected, and there is no longer the need to operate in a over-frosting condition or to perform defrosting in a non-frosting condition as in the prior art. Thus, the freezer can operate at a low energy consumption ratio, and defrosting can also be performed effectively.

We claim:

1. A frost detecting device, comprising: a frost detector including a detecting thermal sensitive element and a compensating thermal sensitive element, the thermal sensitive element and the compensating thermal sensitive element being disposed in a heat conducting metal housing, the housing being partitioned to separate the interior into first and second chambers, the first chamber housing the thermal sensitive element and the second chamber housing the compensating thermal sensitive element, the first chamber being formed with slits which are adapted so that cold air flow thereinto and can be blocked by the formation of frost;

an amplifier circuit for amplifying an output signal from the frost detector;

a comparator circuit for comparing an output voltage from the amplifier circuit with a set voltage from a voltage setting circuit;

an operation detecting circuit for detecting operating conditions of a compressor and a cooling fan; and a judging circuit for detecting existence of frost in accordance with output voltages from the operation detecting circuit and the comparator circuit.

2. A frost detecting device as set forth in claim 1, wherein the output signal from the frost detector is indicative of a temperature differential of a first temperature sensed by the thermal sensitive element and a second temperature sensed by the compensating thermal sensitive element.

3. A frost detecting device as set forth in claim 1, wherein said judging circuit is adapted to detect the existence of frost in accordance with the signal from the frost detector indicating that the temperature differential is approximately zero.

4. A frost detecting device, comprising: a frost detector including a detecting thermal sensitive element and a compensating thermal sensitive element, the thermal sensitive element and the compensating thermal sensitive element being disposed in a heat conducting metal housing, the housing being partitioned to separate the interior into first and second chambers, the first chamber housing the thermal sensitive element and the second chamber housing the compensating thermal sensitive element, the first chamber being formed with slits which are adapted to permit cold air to flow thereinto until blocked by the formation of frost whereupon a temperature differential between the temperature sensed by the thermal sensitive element and the compensating thermal sensitive element proximates zero;

an amplifier circuit for amplifying an output signal from the frost detector;

a comparator circuit for comparing an output voltage from the amplifier circuit with a set voltage level from level setting circuit;

an operation detecting circuit for detecting operating conditions of a compressor and a cooling fan;

a delayed pulse generating circuit which operates in accordance with an output signal from the operation detecting circuit; and a judging circuit for detecting existence of frost in accordance with an pulse output signal from the delayed pulse generating circuit and an output voltage from the comparator circuit.

5. A frost detecting device, comprising: a frost detector including a detecting thermal sensitive element and a compensating thermal sensitive element, the thermal sensitive element and the compensating thermal sensitive element being disposed in a heat conducting housing, the housing being adapted to permit only the thermal sensitive element to be directly exposed to external air until the formation of frost whereupon a temperature differential between the temperature sensed by the thermal sensitive element and the compensating thermal sensitive element proximates to zero;

an amplifier circuit for amplifying an output signal from the frost detector;

a comparator circuit for comparing an output voltage from the amplifier circuit with a set voltage level generated by a level setting circuit;

an operation detecting circuit for detecting operating conditions of a compressor and a cooling fan;

a delayed pulse generating circuit which operates in accordance with an output signal from the operation detecting circuit when the compressor and the cooling fan are both in operation; and a judging circuit for detecting existence of frost in accordance with a pulse output signal from the delayed pulse generating circuit and an output voltage from the comparator circuit.

* * * * *